US010189063B2

(12) United States Patent
Lavender et al.

(10) Patent No.: US 10,189,063 B2
(45) Date of Patent: Jan. 29, 2019

(54) SYSTEM AND PROCESS FOR FORMATION OF EXTRUSION PRODUCTS

(71) Applicant: BATTELLE MEMORIAL INSTITUTE, Richland, WA (US)

(72) Inventors: Curtis A. Lavender, Richland, WA (US); Vineet V. Joshi, Richland, WA (US); Glenn J. Grant, Benton City, WA (US); Saumyadeep Jana, Kennewick, WA (US); Scott A. Whalen, Richland, WA (US); Jens T. Darsell, West Richland, WA (US); Nicole R. Overman, Richland, WA (US)

(73) Assignee: BATTELLE MEMORIAL INSTITUTE, Richland, WA (US)

( * ) Notice: Subject to any disclaimer, the term of this patent is extended or adjusted under 35 U.S.C. 154(b) by 262 days.

(21) Appl. No.: 15/351,201

(22) Filed: Nov. 14, 2016

(65) Prior Publication Data

US 2017/0056947 A1 Mar. 2, 2017

Related U.S. Application Data

(63) Continuation-in-part of application No. 14/222,468, filed on Mar. 21, 2014, now abandoned.
(Continued)

(51) Int. Cl.
*B21C 23/00* (2006.01)
*B21C 23/14* (2006.01)
(Continued)

(52) U.S. Cl.
CPC ..... *B21C 23/002* (2013.01); *B21C 23/14* (2013.01); *B21C 23/212* (2013.01);
(Continued)

(58) Field of Classification Search
CPC ..... B21C 23/001; B21C 23/002; B21C 23/03; B21C 23/035; B21C 23/04; B21C 23/08; B21C 23/085; B21C 23/10; B21C 23/14; B21C 23/18; B21C 23/183; B21C 23/186; B21C 23/20; B21C 23/205; B21C 23/21; B21C 23/212; B21C 23/217;
(Continued)

(56) References Cited

U.S. PATENT DOCUMENTS 3,432,369 A 3/1969 Naastepad
3,640,657 A 2/1972 Rowe et al.
(Continued)

OTHER PUBLICATIONS

Abu-Farha, F., A preliminary study on the feasibility of friction stir back extrusion, Scripta Materialia, 66, 2012, 615-618.
(Continued)

*Primary Examiner* — Peter Dung B Vo
*Assistant Examiner* — Joshua D Anderson
(74) *Attorney, Agent, or Firm* — Derek H. Maughan

(57) ABSTRACT

Devices and processes for performing shear-assisted extrusion include a rotatable extrusion die with a scroll face configured to draw plasticized material from an outer edge of a billet generally perpendicularly toward an extrusion orifice while the extrusion die assembly simultaneously applies a rotational shear and axial extrusion force to the billet.

11 Claims, 6 Drawing Sheets

Related U.S. Application Data

(60) Provisional application No. 62/313,500, filed on Mar. 25, 2016, provisional application No. 61/804,560, filed on Mar. 22, 2013.

(51) Int. Cl.
*B21C 29/00* (2006.01)
*B21C 23/21* (2006.01)
*B21C 27/00* (2006.01)

(52) U.S. Cl.
CPC ..... *B21C 23/218* (2013.01); *B21C 27/00* (2013.01); *B21C 29/003* (2013.01)

(58) Field of Classification Search
CPC ..... B21C 23/218; B21C 25/02; B21C 26/00; B21C 27/00; B21C 29/003; B29C 47/24; B29C 47/361
See application file for complete search history.

(56) References Cited

U.S. PATENT DOCUMENTS 3,661,726 A 5/1972 Denes
3,684,593 A 8/1972 Benz et al.
3,884,062 A * 5/1975 Green ..... B21C 23/004 72/60
3,892,603 A 7/1975 Reid
3,933,536 A 1/1976 Doser et al.
3,977,918 A 8/1976 Palading et al.
4,300,378 A * 11/1981 Thiruvarudchelvan ... B21C 3/12 72/253.1
4,585,473 A 4/1986 Narashimhan et al.
4,778,542 A 10/1988 Pinkerton et al.
4,801,340 A 1/1989 Inoue et al.
4,808,224 A 2/1989 Anderson et al.
4,892,596 A 1/1990 Chatterjee
4,985,085 A 1/1991 Chatterjee
5,026,438 A 6/1991 Young et al.
5,089,060 A 2/1992 Bradley et al.
5,242,508 A 9/1993 McCallum et al.
5,262,123 A 11/1993 Thomas et al.
5,283,130 A 5/1994 Bradley et al.
5,437,545 A 8/1995 Hirai
5,461,898 A * 10/1995 Lessen ..... B29C 47/14 264/209.8
5,470,401 A 11/1995 McCallum et al.
5,737,959 A * 4/1998 Korbel ..... B21B 1/166 72/256
6,022,424 A 2/2000 Sellers et al.
6,036,467 A 3/2000 Jameson
6,940,379 B2 9/2005 Creighton
7,096,705 B2 * 8/2006 Segal ..... B21C 23/001 72/253.1
7,322,508 B2 1/2008 Chang et al.
8,313,692 B2 11/2012 Somekawa et al.
2006/0005898 A1 1/2006 Liu et al.
2010/0132430 A1 * 6/2010 Tsai ..... B21C 25/00 72/467
2012/0006086 A1 * 1/2012 Manchiraju ..... B21C 23/002 72/253.1
2014/0002220 A1 1/2014 Johnson et al.
2014/0102161 A1 * 4/2014 Stewart ..... B21C 23/212 72/264
2015/0075242 A1 3/2015 Eller et al.

OTHER PUBLICATIONS

Rodewald, W, et al., Top Nd-Fe-B Magnets with Greater Than 56 MGOe Energy Density and 9.8 kOe Coercivity, IEEE Transactions on Magnetics, vol. 38, No. 5, Sep. 2002, 2955-2957.
Office Action for U.S. Appl. No. 14/268,220, filed Jun. 2, 2015, First Named Inventor Jun Cui, dated Dec. 1, 2015.
Office Action for U.S. Appl. No. 14/222,468, filed Mar. 21, 2014, First Named Inventor Curtis A. Lavender, dated Nov. 6, 2015.
Office Action for U.S. Appl. No. 14/222,468, filed Mar. 21, 2014, First Named Inventor Curtis A. Lavender, dated Apr. 1, 2016.
Office Action for U.S. Appl. No. 14/222,468, filed Mar. 21, 2014, First Named Inventor Curtis A. Lavender, dated May 20, 2016.

* cited by examiner

SYSTEM AND PROCESS FOR FORMATION OF EXTRUSION PRODUCTS

CROSS REFERENCE TO RELATED APPLICATIONS

This application is a Continuation-In-Part of U.S. Provisional Application No. 62/313,500 filed 25 Mar. 2016, and pending U.S. patent application Ser. No. 14/222,468 filed 21 Mar. 2014 which claims priority from U.S. Provisional Application No. 61/804,560 filed 22 Mar. 2013, which are incorporated in their entirety herein.

STATEMENT REGARDING RIGHTS TO INVENTION MADE UNDER FEDERALLY-SPONSORED RESEARCH AND DEVELOPMENT

This invention was made with Government support under Contract DE-AC05-76RL01830 awarded by the U.S. Department of Energy. The Government has certain rights in the invention.

FIELD OF THE INVENTION

The present invention relates generally to production of metal products more particularly to shear-assisted extrusion systems and processes for producing light-weight, high-performance extrusion products.

BACKGROUND OF THE INVENTION

A need exists for light-weight metal products that can be used to reduce weight and improve fuel efficiency in applications such as vehicles in the transportation sector. The use of harder light-weight alloys such as those containing magnesium are of particular interest due to their high strength-to-weight ratio, and ductility that makes their use in structural components desirable. However, problems exist in attempting to form products, particularly hollow products from these harder metal alloys. For example, harder alloys typically require substantially larger forces for extrusion and routinely generate extrusion products with inconsistent and non-uniform microstructures which lead to problems in strength and reliability. Conventional processes for forming such devices can also highly energy consumptive processing or multiple steps to achieve desired features which can adds significant costs. The described invention is a system and process for performing shear extrusion that overcomes these problems and enables the creation of high strength hollow structures from harder metals and metal alloys.

The purpose of the foregoing abstract is to enable the United States Patent and Trademark Office and the public generally, especially scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

SUMMARY OF THE INVENTION

The present embodiments of the invention describe devices and processes for performing shear-assisted extrusion including a rotatable extrusion die with a scroll face configured to draw plasticized material from an outer edge of a billet generally perpendicularly toward an extrusion orifice while the extrusion die assembly simultaneously applies a rotational shear and axial extrusion force to the billet. In this configuration the plasticized billet material extrudes through the extrusion die orifice to yield an extrusion product with a microstructure having grains in the extrusion product that are about one-half the size of the grains prior to extrusion. These grains and their orientation are typically uniform throughout the resulting product and provide desired characteristics to the resulting material.

In some embodiments the scroll face includes raised ridges that extend upward from the face of the extrusion die to form flow path channels that extend from the outer edge of the scroll toward the center of the die so as to draw plasticized billet material from the outer edge of the billet toward the extrusion orifice as the scroll spins. These ridges may be arranged in a pattern having comprising at least one start on the scroll face configured to engage the plasticized material during operation. In other embodiments there are two or even three starts. The some embodiments a container defines a chamber with a fixed mandrel that is placed at a central position within the chamber. The mandrel is configured to connect to and mount upon the billet within the chamber prior to extrusion. When the mandrel is present the extrusion products that are created are generally hollow or have hollow portions.

The extrusion process of some embodiments of the invention comprises the steps of simultaneously applying a rotational shearing force and an axial extrusion force to an end of a billet while contacting one an end of the billet with a scroll face configured to engage the end of the billet and move plasticized billet material toward an orifice of the extrusion die whereby the plastically deformed billet material flows substantially perpendicularly from an outer edge of the billet through the orifice of the extrusion die to form to form forming an extrusion product with microstructure grains being about one-half the size of the grains in the billet prior to extrusion. In some applications, the axial extrusion force per unit area is less than 100 MPa, sometimes less than 50 MPa, and sometimes even less than 25 MPa, and the temperature of the billet is less than 100° C. Typically, the feed rate is less than 0.2 inches (0.51 cm) per minute and the rotational shearing force is generated from spinning the die or the billet at a rate between 100 rpm to 500 rpm. Typically, the resultant products created from such a process have various desired features including microstructure grains that can be non-parallelly oriented with respect to the extrusion axis, grains that can be equi-axial in all three dimensions, and microstructures with grains that can have sizes below about 10 microns, sometimes below about 5 microns, and sometimes even less than or equal to about 1 micron.

Various advantages and novel features of the present invention are described herein and will become further readily apparent to those skilled in this art from the following detailed description. In the preceding and following descriptions I have shown and described only the preferred embodiment of the invention, by way of illustration of the best mode contemplated for carrying out the invention. As will be realized, the invention is capable of modification in various respects without departing from the invention. Accordingly, the drawings and description of the preferred embodiment set forth hereafter are to be regarded as illustrative in nature, and not as restrictive.

DETAILED DESCRIPTION OF THE INVENTION

The following paragraphs set forward a description of various illustrative embodiments of the present invention. It to be understood that these various embodiments are not comprehensive of all of the potential alterations and modifications at that various alternative modifications and alterations can be made to the embodiments and are contemplated as a scope of the present invention.

Figure 1:
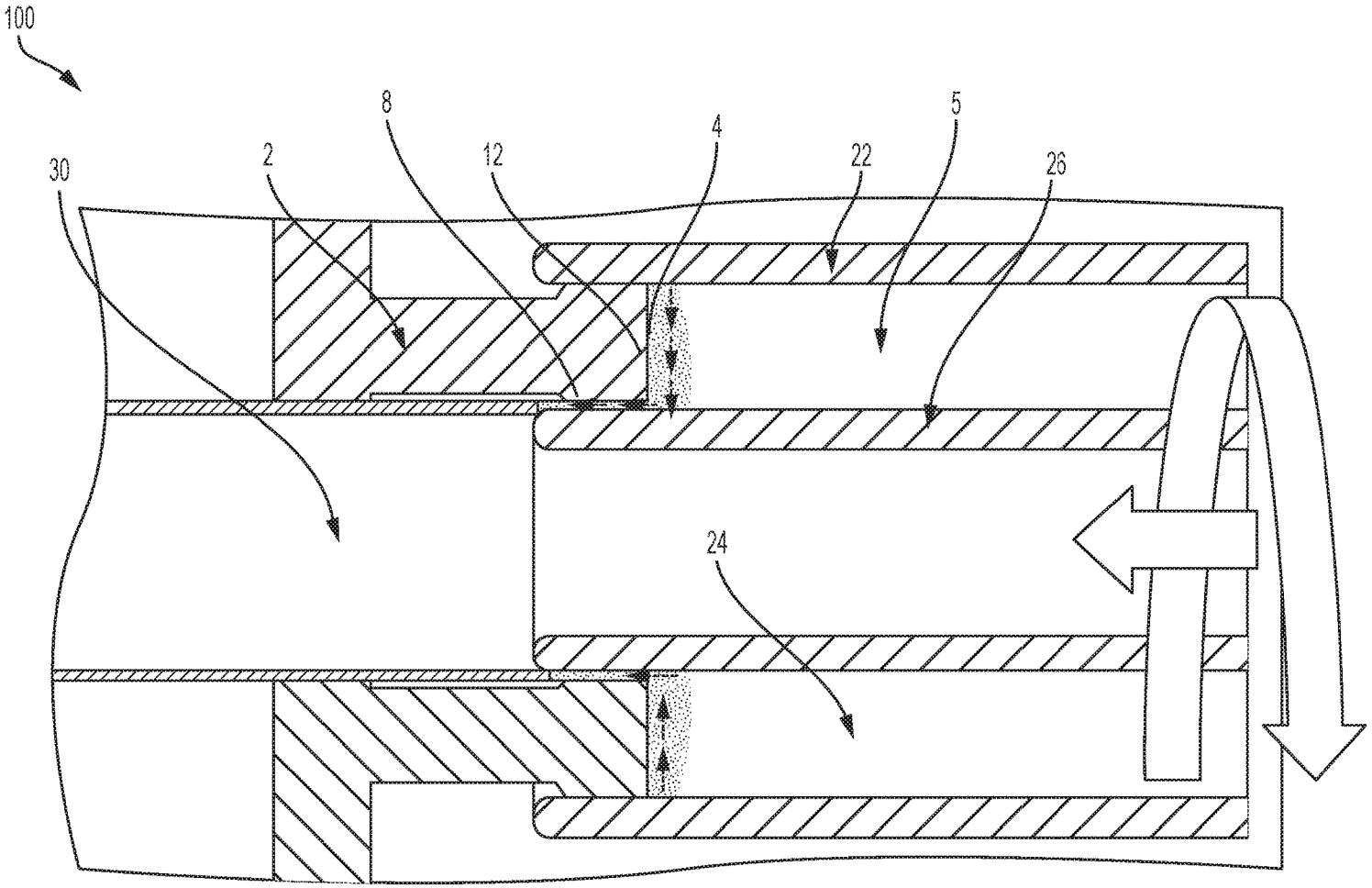
FIG. 1 shows a cut away view of a first embodiment of the present invention.

FIGS. 1-6 show various exemplary embodiments, examples and information regarding devices and processes that produce high-performance extrusion products from a variety of materials including harder metal alloys such as magnesium, aluminum, titanium and the like. Processes for producing these high-performance extrusion products are also described hereafter. Referring first to FIG. 1, a shear-assisted extrusion apparatus of a direct extrusion type is shown. FIG. 1 shows a cut-away view of an extrusion assembly 100 according to one embodiment of the invention. In this embodiment, assembly 100 is configured to push a billet 5 against a scroll face 4 while simultaneously spinning the scroll face 4 against the billet 5 or the face of the billet 5 against the scroll face 4. In this embodiment, a rotatable extrusion die 2 with the scroll face 4 in contact with billet 5 is configured to draw plasticized material from an outer edge of the billet with the scroll face 4 toward an extrusion die orifice 8 in a generally perpendicular direction. When the spinning and pushing occurs, material on the face of the billet is plasticized and begins to flow. Extrusion orifice 8 is positioned so that plasticized material will not flow through the orifice until the plasticized billet material is sufficiently soft so as to flow through the opening 8 which is generally perpendicularly oriented with regard to the face of the billet 5. Under reduced pressures, the desired level of plasticization of the face of the billet is achieved before the plasticized billet material flows through the extrusion orifice 8 and extruded through the extrusion die 2 to yield an extrusion product 30.

Preferably, the extrusion product 30 includes a microstructure having grains that are generally in an aligned orientation and are about one-half the size of the grains in the billet prior to extrusion. The alignment of grains in basal planes determines the structural and functional properties of the extruded product 30. For example, off axis alignment of basal planes within magnesium tubing is desirable for the automotive industry because desired mechanical behaviors in certain applications, such as strength in a first orientation and crushability in a second orientation can be more fully optimized. In addition to providing these results in the resulting products, this process also reduces the energy requirements for forming the products. Typically, conventional extrusion requires high extrusion pressures on the order of 400 MPa or higher to push these types of materials through a reduced opening. The present embodiments are able to achieve better resulting structures with extrusion forces that are an order of magnitude lower.

Figure 2C:
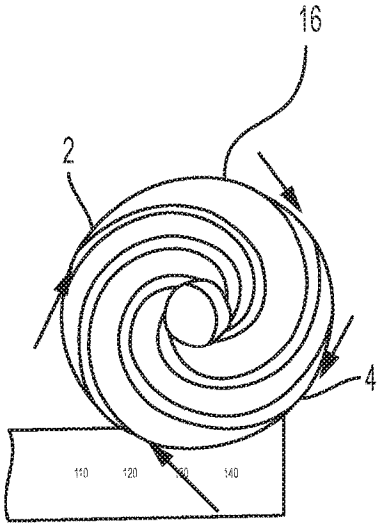
FIG. 2A-2C show various embodiments of scrolls utilized in the described embodiments.
Figure 2B:
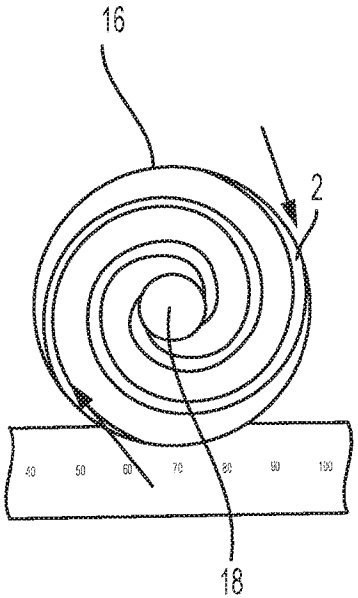
Figure 2A:
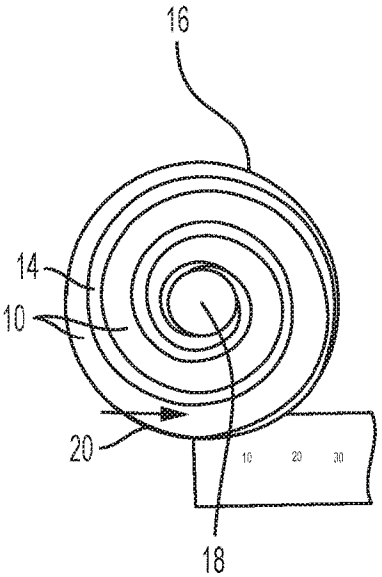

Referring now also to FIGS. 2A-2C, in some embodiments of the invention, the scroll face 4 is connected to the extrusion die 2. The scroll face 4 includes raised ridges 10 that extend upwards from the scroll face 4 to form at least one flow path channel 14 that extends from the outer edge of the die 16 (and typically coextensively with the outer edge of the complementary coupled billet 5) towards the center of the die 18 which serves to draw plasticized billet material from the outer edge of the billet 5 toward the extrusion orifice 8 as the scroll face 4 or billet 5 alternatively spins. Generally speaking, flow path channels 14 on the scroll face 4 occur in regular patterns that pull and direct plasticized material towards the generally centrally disposed extrusion orifice 8. In some embodiments, these flow path channels may be disposed generally circumvolvingly with various numbers of starts 20 positioned therein to promote the flow of plasticized materials.

In other embodiments, scroll faces 4 may include radial patterns such as contiguous and non-contiguous arrangements or other arrangements that may all be used to achieve desired results. In one embodiment of the invention, a scroll face 4 was machined onto the face of an extrusion die 2 with a pattern or arrangement in the form of a spiral that included ridge features 10 with channels 14 positioned between the respective turns of the ridge features of the spiral pattern to draw plasticized billet material from the outer edge of the billet toward the extrusion orifice 8 positioned at the center of the die 18 during extrusion processing. In one example, the scroll channels 24 had an exemplary width of 2.72 mm, a depth of 0.47 mm, and a pitch distance (distance between ridge features in respective turns of the spiral pattern) of 4.04 mm. The scroll included two starts 20 that completed 2.25 turns in the scroll 4.

Referring back to FIG. 1, in the described embodiment, a container 22 defines a chamber 24 with a mandrel 26 (in this case a fixed mandrel) disposed at a generally central position within the chamber 24. The mandrel 26 is configured to connect to and hold the billet 5 within the chamber 24 prior to extrusion. In this embodiment, the presence of the mandrel 26 enables the formation of hollow extrusion products 30 such as tubing, as the plasticized billet material flows through the opening 8 and around the mandrel 26 (now inserted within the extrusion die 2). Depending upon the needs of the user, the mandrel 26 can be fixed to another portion of the device, or can float. In addition, in some embodiments, a chilled mandrel may be used. In other embodiments, the absence of a mandrel 26 allows solid extrusion products to be produced with a variety of shapes and sizes.

Figure 3:
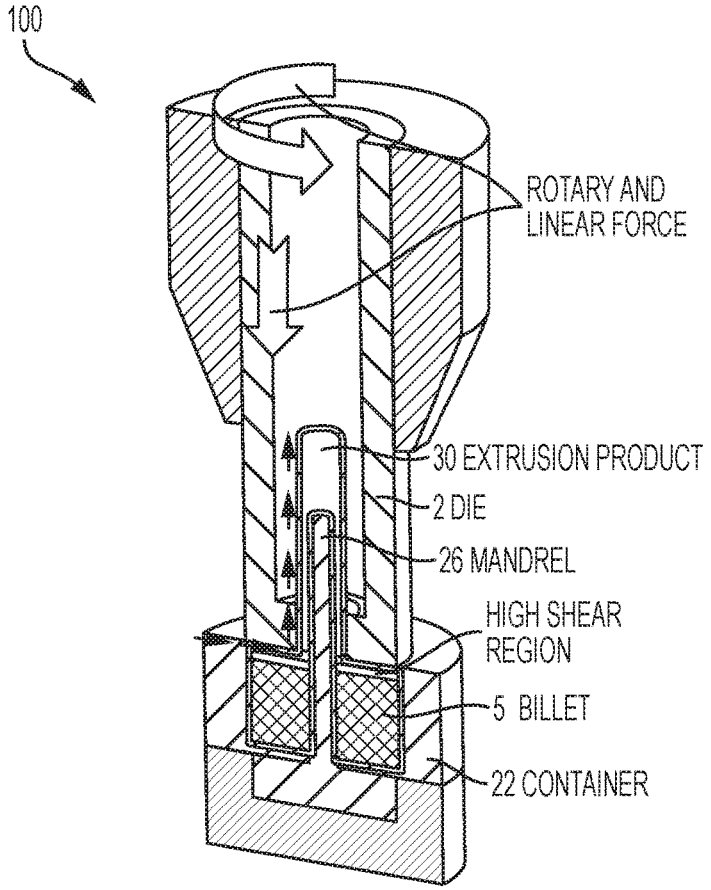
FIG. 3 shows a cut-away perspective view of a second embodiment of the present invention.

Referring now to FIG. 3, a cut-away perspective view of another embodiment of the invention is shown. In FIG. 3, the extrusion assembly 100 is configured to engage a billet 5 by both pushing and spinning the scroll face 4 against the billet 5 to achieve plasticization. In this type of extrusion, called indirect extrusion, the scroll face 4 spins and pushes against the billet 5 forcing the plasticized billet material to extrude back toward the direction of the axial extrusion force, rather than in the same direction as the axial extrusion force described previously in reference to FIG. 1. In either instance, material will not flow generally perpendicularly through the orifice 8 until the plasticized billet material is sufficiently soft so as to flow through the opening 8. This results in significantly lower extrusion pressures than are taught in the prior art, and further results in extrusion products 30 that have a microstructure with grains that are generally in an aligned orientation and are about one-half the size of the grains in the billet prior to extrusion.

This ability to align grains in a selected orientation is unique because it enables the user to modify and tailor the texture while simultaneously refining and densifying the grains resulting in an extrusion product with a uniform microstructure in a single extrusion step. Aligning refined and consolidated grains in a selected orientation can be effected by adjusting one or more of: the billet feed rate, rotational shear forces as a function of selected rotation speeds of the extrusion die, axial extrusion forces, and combinations of these various factors as detailed herein, which can improve or enhance physical properties such as strength and hardness of the extrusion products. In addition, by altering plasticization characteristics on the face of the billet, better structures and control result. This is particularly important in the formation of structures made from harder materials such as magnesium alloys like AZ91E and AZ31F; magnesium aluminum (Mg Al) alloys; magnesium zinc (Mg Zn) alloys; magnesium zirconium (Mg Zr) alloys; magnesium silicon (Mg Si) alloys (e.g., Mg-2Si; Mg-7Si); magnesium/rare earth alloys; magnesium/non-rare-earth alloys; and magnesium zinc-zirconium alloys (e.g., ZK60-T5).

This refinement of grains and basal texture begins to develop as the plasticized billet material flows toward the orifice 8 of the extrusion die 2. Then, the refined grains and developed texture propagate through the plasticized material as it is extruded in the extrusion die 2. Preferably, the microstructure grains are achieved by generating a scroll face temperature from about 350° C. to about 500° C. Because the area between the billet face 5 and the orifice 8 is the location where the temperature must be elevated to achieve plasticization, the present invention does not require the heating of a billet and can be performed at room temperature. The billet can even be cooled to subzero temperatures and utilized in the present invention. Experiments have shown preferred rotation speeds are at or below about 500 rpm, feed rates from about 0.15 inches (0.38 cm) per minute to about 1.18 inches (3.0 cm) per minute at axial extrusion pressures below 50 MPa.

Example 1

In one set of experiments, a direct extrusion assembly similar to that shown in FIG. 1 was used to extrude an exemplary magnesium alloy (ZK60A-T5) to produce exemplary tubes by direct extrusion. The extrusion die 2 included an inner diameter (ID) of 50.8 mm that determined the outer diameter (OD) of the resulting extrusion product 30. An integrated container 22 and mandrel 26 assembly was used. In the exemplary embodiment, container 22 included an ID of 88.9 mm and the mandrel 26 included an OD of 47.8 mm. The difference in the radius between the ID of the extrusion die 2 and OD of the mandrel 26 was 1.52 mm, which determined the wall thickness of the extrusion product 30. Hollow billets 5 of the ZK60 alloy were machined from a round bar stock, and then extruded to form tubes 30 with an OD of 88.8 mm, an ID of 47.9 mm, and a length of 113 mm. Billets were not preheated, and ambient conditions in the processing location were less than 100° C. Cylindrical pockets (e.g., four) were machined into one end of the billet 5 and keyed to the container 22 to prevent undesired movement of the billet in the container during processing. Components of the extrusion assembly were mounted into a friction stir welding machine (e.g., TTI LS2-2.5, Transformation Technologies, Inc., Elkhart, Ind., USA) capable of simultaneously applying an axial force of, for example, up to 120 kN and a 1000 N-m of torque at a speed of 200 rpm. Billets 5 were directly extruded at an extrusion ratio of 17.7 into round tubes 30 having an outer diameter of 50.8 mm and a wall thickness of 1.52 mm. Shearing conditions resulted in microstructural refinement with an average grain size of 3.8 μm measured at the midpoint of the tube wall. Tensile testing (ATSM E-8) on specimens oriented parallel to the extrusion direction gave an ultimate tensile strength of 254.4 MPa and elongation of 20.1%. Specimens tested perpendicular to the extrusion direction had an ultimate tensile strength of 297.2 MPa and elongation of 25.0%. A surprisingly low extrusion force of 40 kN was needed to extrude the tubes (at a k-factor of 3.33 MPa), representing a greater than 20-fold reduction compared to typical conventional extrusion forces (800 kN to 1,655 kN) estimated for this same alloy based on an equivalent k-factor.

Example 2

In another set of experiments, an indirect extrusion assembly similar to that shown in FIG. 3 was used to extrude another exemplary magnesium alloy (AZ91E) to prepare thin-walled tubing by indirect extrusion. Melt spun, rapidly solidified flakes of the AZ91E alloy were formed into a billet 5 and loaded into a cylindrical container 22 (I.D. of 31.8 mm; Height of 21.0 mm). Face 12 of the extrusion die 2 included a single spiral scroll 4 that promoted flow of plasticized material through the centrally positioned extrusion orifice 8 (7.5 mm diameter) into the inner bore (throat) of the extrusion die 2. The extrusion die 2 included a 6.4 mm long throat, and a 90° relief to minimize friction between the inner wall of the die throat and the extrusion product 30. Plasticized material was then back-extruded through a 0.75 mm gap disposed between the exterior surface of the mandrel 26 and the inner wall of the die throat, resulting in formation of the tube. Rotational speed and axial extrusion force of the extrusion die were controlled using an ultra-high precision friction stir welding machine (e.g., TTI LS2-2.5) to regulate applied torque and heat generated during processing of extruded tubes. Maximum extrusion force reached 17 kN approximately 35 seconds into the run at a temperature of 350° C., which decreased rapidly thereafter to a force of 10 kN (2248 $lb_f$) and a temperature of ~170° C. ~50 seconds into the run, indicating a softening of the billet material and extrusion of the alloy. Resulting tubes included an outer diameter of 7.5 mm, an inner diameter of 6.0 mm, and a wall thickness of 0.75 mm.

Figure 4:
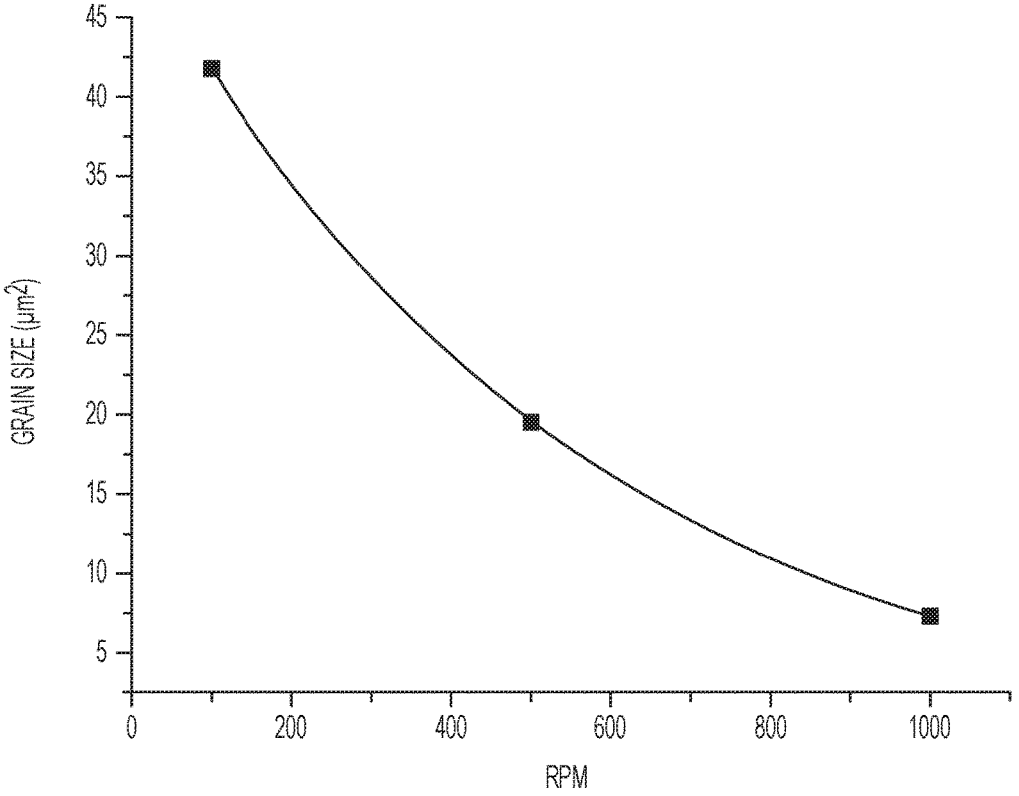
FIG. 4 shows a plot of grain size to processing rpm derived from one set of experiments performed using one embodiment of the present invention.

Embodiments of the present invention enable the formation of microstructures having a generally uniform distribution of fine grains with a size less than or equal to about 10 microns. In some embodiments, the process yields a microstructure containing ultra-fine grains with a size less than or equal to about 1 micron. The process of the present application alters the morphology of particles in a billet material to an aspect ratio below about 2. FIG. 4 shows a plot of the relationship between grain size and rotation speed under a constant linear force. Further, grain alignment in the resulting product can be preferentially selected by altering the axial feed rate and the rotation speeds during processing. In one set of experiments (ZK60), grain density was shown to increase from a Multiples of Uniform Distribution (MUD) maximum of 16.7 to an MUD value of 22.1, demonstrating the effect of process parameters on the resulting grain refinement and texture. This control over grain refinement and crystallographic grain orientation directly correlates with improvements in material properties in the resulting structures extending beyond conventional axial extrusion approaches.

Example 3

TABLE 1 lists compositions of alloy billets and process parameters employed in selected extrusion tests using an indirect extrusion assembly similar to the arrangement shown in FIG. 3.

TABLE 1

| Test # | Alloy | Rotation Speed (rpm) | Feed Rate (inches/min) | Extrusion Force ($lb_f$) |
|---|---|---|---|---|
| 1 | Mg—2Si | 500 | 0.15 | 2000 |
| 2 | Mg—7Si | 500 | 0.15 | 2000 |
| 3 | AZ31F | 500 | 0.15 | 2000 |
| 4 | ZK60-T5 | 500 | 0.15 | 2000 |
| 5 | AZ91 | 500 | 0.15 | 2000 |

TABLE 2 lists dimensions of exemplary hollow extrusion products obtained from extrusion tests listed in Table 1.

TABLE 2

| Test | | O.D. | | I.D. | | Extrusion | Extrusion Rate (Inches/ |
|---|---|---|---|---|---|---|---|
| # | Alloy | Inches | mm | Inches | mm | Ratio | min) |
| 1 | Mg—2Si | 0.292 | 7.42 | 0.231 | 5.87 | 48.977 | 7.347 |
| 2 | Mg—7Si | 0.291 | 7.39 | 0.233 | 5.92 | 51.412 | 7.712 |
| 3 | AZ31F | 0.291 | 7.39 | 0.232 | 5.89 | 50.637 | 7.596 |
| 4 | ZK60-TS | 0.293 | 7.44 | 0.23 | 5.84 | 47.422 | 7.113 |
| AVERAGE | | 0.292 | 7.41 | 0.232 | 5.88 | 49.612 | 7.442 |
| STD. DEV. | | 9.5E−4 | 2.4E−2 | 1.3E−3 | 0.033 | 1.779 | 0.267 |

Extrusion rate for these tests was about 7.5 inches per minute, but rates are not limited. For example, rates can vary based on selected processing parameters, for example, from several inches per minute to several feet per minute, or greater. Maximum extrusion pressure applied during shear-assisted extrusion for most of these experiments was less than about 20 MPa at a displacement distance of 0.13 inches (0.32 cm). Results show significantly lower extrusion forces are required for extrusions performed with the scroll face and design of the present embodiment. For example, extrusion pressures in conventional dies (i.e., without the scroll) are typically greater than 400 MPa (e.g., 430 MPa) at a temperature of 350° C. when billets are already soft, forces greater than 20 times that needed during shear-assisted processing and extrusion of the present invention.

Figure 5:
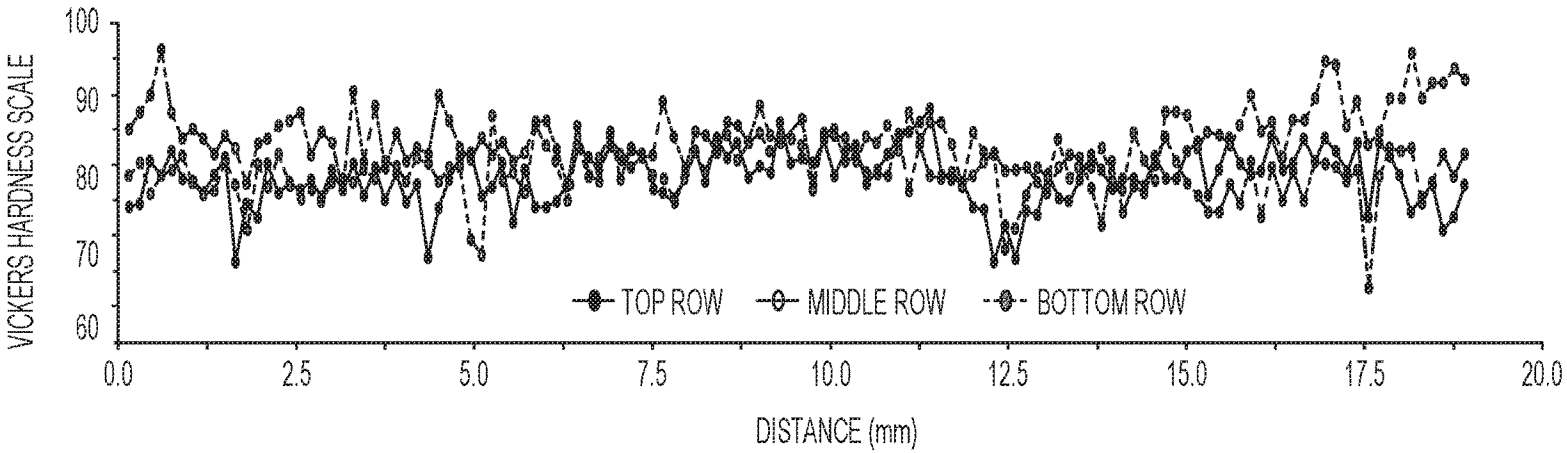
FIG. 5 shows a graph demonstrating the Vickers Hard Scale hardness distribution across a product created using one embodiment of the present invention.

One of the extrusion tubes fabricated in this example (ZK60) demonstrated a microstructure with basal planes aligned at an angle 45° to the extrusion axis. Basal planes in a similar conventional extrusion microstructure would typically be parallel to the extrusion axis. In one example (AZ91 alloy), three sections of a tube generated by this process were tested for hardness to map the microstructure properties of the extruded tube. FIG. 5 plots the Vickers Hard Scale hardness of the resulting tube, demonstrating that the hardness is relatively consistent along the length of the tube which is consistent with the general uniformity of the microstructure through the thickness of the tube.

Figure 6:
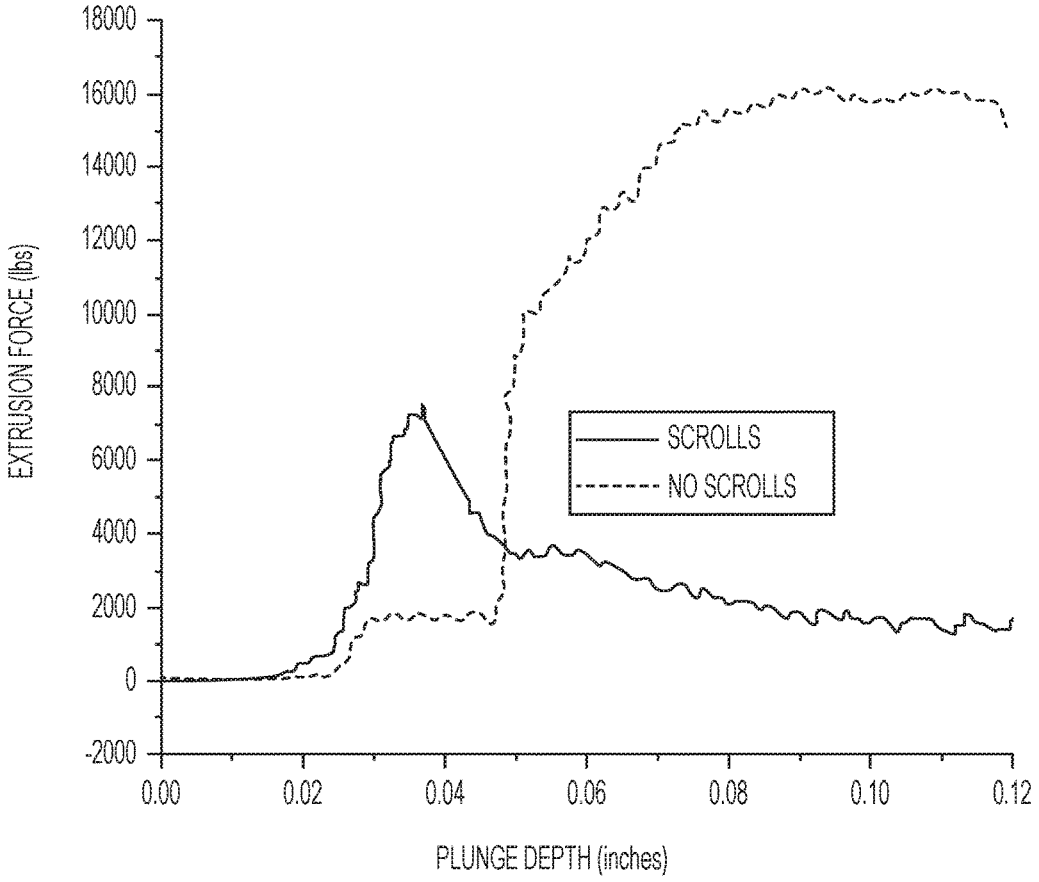
FIG. 6 shows a graph demonstrating the effect of a scroll on performance in one embodiment of the invention.

FIG. 6 shows the effect of a scroll 4 on the flow of plasticized billet material (ZK60 magnesium alloy) through the narrow deformation zone at the extrusion die/billet interface at an exemplary rotation speed (500 rpm). As shown, with the scroll present, the extrusion force required to move materials through the orifice is significantly reduced when a scroll is utilized to move plasticized material from the outer edge of the billet toward the extrusion orifice at the center of the extrusion die.

Example 4

Several extrusion runs were made to produce tubes composed of an exemplary magnesium alloy (ZK60) processed in accordance with the present invention at different rotation speeds and feed rates. Results for one set of extrusion conditions are detailed. Billets were rotated at a speed of 250 rpm and pushed against the extrusion die at a constant rate of 0.15 inches/min (3.81 mm/min). Extrusion force and torque built rapidly about 20 seconds after contact was made between the billet and die, rising to peaks of 47.1 kN and 697 N-m, respectively. Thermocouple readings taken near the die orifice indicated the peak extrusion (ram) force and torque were reached at a temperature of 230° C. Thereafter, force and torque fell sharply indicating that the billet material had begun to soften and extrude through the die. Rotation speed was then reduced to 200 rpm for the remainder of the experiment. Temperature at the orifice stabilized near 475° C. During the last two minutes of the test at the operating condition, the axial extrusion force averaged 40 kN (~9000 $lb_f$) and the torque averaged 550 N-m. Results show the extrusion force required for extrusion represents a greater than 10-fold reduction compared to conventional direct extrusion.

Example 5

Several extrusion runs were made using an indirect extrusion assembly similar to that shown in FIG. 3 to produce rods composed of an exemplary aluminum alloy (AI6061). In this example, billets were rotated at different speeds and pushed against the extrusion die at a constant feed rate of 0.15 inches (3.8 mm) per min. Face of the extrusion die included a spiral scroll with four starts to promote flow of plasticized material through the centrally positioned extrusion orifice. TABLE 3 lists results.

TABLE 3

| TEST # | Alloy | Rotation Speed (rpm) | Feed Rate (inches/min) | Peak Temperature (° C.) | Extrusion Force ($lb_f$) | Extrusion Ratio |
|---|---|---|---|---|---|---|
| 1 | Al6061 | 150 | 0.15 | 400 | 2750 | 18 |
| 2 | Al6061 | 500 | 0.15 | 440 | 2000 | 18 |
| 3 | Al6061 | 1000 | 0.15 | 480 | 2000 | 18 |

Extruded rods had a diameter of 7.5 mm. Extrusion rate for these tests was about 6 inches per minute but rates are not limited. For most experiments, temperatures at the die orifice typically stabilized in the range from about 350° C. to about 500° C. Texture of the extruded materials also changed from the original state. Average grain size in the extruded rods was about 12 μm at rotation speeds of 500 rpm or lower. Extrusion forces were also reduced without preheating the billet compared to conventional indirect extrusion of aluminum alloys. For example, conventional processing typically involves preheating billets prior to extrusion for several hours or more (e.g., 4-5 hours) at temperatures from about 400° C. to about 450° C. (depending on the mass of the billet) to reduce extrusion pressures.

Processing and extrusion of material using the present invention results in more uniform extrusion products with finer grain sizes. The present invention also improves texture that can increase strength and other improvements to properties. The method also requires significantly less energy (orders of magnitude less) than conventional methods. As such, the overall energy input to the process and costs can be greatly reduced compared to conventional heating. The present invention also provides better results in a single step, which are not obtained in conventional processes. Processes of the present invention provide extrusion products that may find application as parts, pieces, or components in various devices and light-weight structures such as lightweight automobile parts like bumpers, automotive crush tips, door beams, and pillar structures.

While preferred embodiments of the present invention have been shown and described, it will be apparent to those of ordinary skill in the art that many changes and modifications may be made without departing from the invention in its true scope and broader aspects. The appended claims are therefore intended to cover all such changes and modifications as fall within the spirit and scope of the invention.

What is claimed is:

1. An extrusion device for shear-assisted extrusion, comprising:

an extrusion die with a scroll face in the form of a spiral that surrounds an extrusion orifice arranged in a center of the extrusion die, the scroll face configured to spin with respect to a billet to draw plasticized billet material from an outer edge of the billet in contact with the scroll face toward the extrusion orifice while applying a simultaneous rotational shear and axial extrusion force to the billet; whereby the extrusion die is configured to extrude the plasticized billet material through the extrusion orifice yielding an extrusion product with microstructure grains in the extrusion product that are one-half the size of microstructure grains in the billet prior to extrusion.

2. The device of claim 1, wherein the scroll face includes raised ridges that extend from a face of the extrusion die to form flow path channels that extend from an outer edge of the extrusion die toward the center of the extrusion die so as to draw the plasticized billet material from the outer edge of the billet toward the extrusion orifice as the scroll spins with respect to the billet.

3. The device of claim 2, wherein the raised ridges are arranged in a pattern comprising at least one start on the scroll face.

4. The device of claim 1, further comprising a container defining a chamber with a fixed mandrel disposed at a central position within the chamber, the mandrel configured to connect to and mount the billet within the chamber prior to extrusion.

5. An extrusion process, comprising the steps of:

simultaneously applying a rotational shearing force and an axial extrusion force to a billet while contacting one end of the billet with a scroll face of an extrusion die in the form of a spiral that surrounds an extrusion orifice arranged in a center of the extrusion die, the scroll face configured to spin with respect to the billet to engage and move plasticized billet material toward the extrusion orifice whereby the plastically deformed billet material flows from an outer edge of the billet through the orifice forming an extrusion product with microstructure grains one-half the size of microstructure grains in the billet prior to extrusion.

6. The process of claim 5, wherein an extrusion pressure from the axial extrusion force is less than 50 MPa during extrusion and the billet does not require preheating before extrusion.

7. The process of claim 6, wherein a billet feed rate is less than 0.2 inches (0.51 cm) per minute and the rotational shearing force is generated from spinning the extrusion die or the billet at a rate between 100 rpm to 500 rpm.

8. The process of claim 5, wherein the billet contains a magnesium alloy.

9. A shear-assisted extrusion process for forming products of a desired composition from billets of a magnesium alloy comprising the steps of:

simultaneously applying a rotational shearing force and an axial extrusion force to the same location on the billet with a scroll face of an extrusion die in the form of a spiral that surrounds an extrusion orifice arranged in a center of the extrusion die, the scroll face configured to spin with respect to the billet to plasticize billet material from the billet while extruding the plasticized billet material through the orifice of the extrusion die forming an extrusion product whereby microstructure grains in the extrusion product are one-half the size of microstructure grains in the billet prior to extrusion.

10. The process of claim 9, wherein the billet does not require preheating before extrusion.

11. The process of claim 9, wherein an extrusion pressure from the axial extrusion force is at or below 100 MPa.

* * * * *